US009593890B2

(12) United States Patent
Alhazmy

(10) Patent No.: US 9,593,890 B2
(45) Date of Patent: Mar. 14, 2017

(54) THERMAL CONTROL INSERT AND THERMAL RESISTANT HOLLOW BLOCK

(71) Applicant: KING ABDULAZIZ UNIVERSITY, Jeddah (SA)

(72) Inventor: Majed Moalla Alhazmy, Jeddah (SA)

(73) Assignee: KING ABDULAZIZ UNIVERSITY, Jeddah (SA)

( * ) Notice: Subject to any disclaimer, the term of this patent is extended or adjusted under 35 U.S.C. 154(b) by 625 days.

(21) Appl. No.: 14/080,668

(22) Filed: Nov. 14, 2013

(65) Prior Publication Data

US 2015/0129184 A1 May 14, 2015

(51) Int. Cl.

| | |
|---|---|
| ***F28F 21/04*** | (2006.01) |
| ***F28F 7/02*** | (2006.01) |
| ***F28F 1/40*** | (2006.01) |
| ***F28D 1/03*** | (2006.01) |
| *E04B 2/02* | (2006.01) |

(52) U.S. Cl.

CPC ..... *F28F 7/02* (2013.01); *F28D 1/0358* (2013.01); *F28F 1/40* (2013.01); *F28F 21/04* (2013.01); *E04B 2002/0289* (2013.01)

(58) Field of Classification Search

CPC ..... E04B 2/14; E04B 2/16; E04B 2/28; F28F 7/02; F28F 1/40; F28F 21/04; F28D 1/0358

USPC ..... 165/135, 109.1; 52/405.1, 404.1, 406.2, 52/405.3, 407.5, 404.5

See application file for complete search history.

(56) References Cited

U.S. PATENT DOCUMENTS

| | | | | |
|---|---|---|---|---|
| 3,885,363 | A | 5/1975 | Whittey | |
| 4,193,241 | A | 3/1980 | Jensen et al. | |
| 4,269,013 | A * | 5/1981 | West | E04B 2/48 52/405.1 |
| 4,424,712 | A * | 1/1984 | Scheer | G01P 15/034 73/514.02 |
| 4,462,195 | A | 7/1984 | Nickerson | |
| 5,062,244 | A | 11/1991 | Ducharme | |
| 5,349,798 | A * | 9/1994 | Gross | E04C 1/40 52/309.12 |
| 5,746,037 | A | 5/1998 | Nordberg | |
| 8,091,307 | B2 * | 1/2012 | Alhazmy | E04B 2/14 52/404.1 |

(Continued)

FOREIGN PATENT DOCUMENTS

| | | |
|---|---|---|
| CN | 201224943 Y | 4/2009 |
| CN | 201326237 Y | 10/2009 |

OTHER PUBLICATIONS

Omniblock Website, available online, www.omniblock.com, 2 pages.

*Primary Examiner* — Tho V Duong
(74) *Attorney, Agent, or Firm* — Richard C. Lltman

(57) ABSTRACT

A thermal control insert and a thermal resistant hollow block. The thermal resistant hollow block includes a hollow block having a cavity and an elongate member positioned within the cavity that has a generally spiral shaped pathway which forms a generally closed pathway to receive a heated fluid when the elongate member is positioned within the cavity of the hollow block. The generally spiral shaped pathway passes the heated fluid in a forward direction through the generally closed pathway toward a central open area at an inner end of the generally closed pathway of the elongate member. As fluid accumulates in the central open area, the fluid loses kinetic energy and becomes stagnant to provide a relatively high thermal resistance to heat transfer.

16 Claims, 5 Drawing Sheets

(56) References Cited

U.S. PATENT DOCUMENTS

| | | | | |
|---|---|---|---|---|
| 2010/0090924 | A1* | 4/2010 | Honda | H01Q 1/36<br>343/872 |
| 2012/0097597 | A1* | 4/2012 | Billovits | B01D 63/10<br>210/321.83 |

* cited by examiner

THERMAL CONTROL INSERT AND THERMAL RESISTANT HOLLOW BLOCK

BACKGROUND OF THE INVENTION

1. Field of the Invention

The present invention relates to building materials, and particularly to a thermal control insert for hollow blocks and a thermal resistant hollow block.

2. Description of the Related Art

Certain regions of the world experience high temperatures that can exceed comfort levels for habitability. Countries such as Saudi Arabia and other Arabian Gulf states can experience high ambient temperatures throughout the year. In these countries it can often be necessary for extensive use of air conditioning systems to maintain thermal comfort in buildings. For example, in Saudi Arabia, it is estimated that at least about 70% of the energy available for buildings is consumed by air conditioning alone. The rate of external heat penetrating into buildings, which is the main component of thermal load, can depend on a number of factors, such as the thermal resistance of the building materials.

External heat from an outside environment can penetrate into interiors of buildings in a number of ways. The external heat can penetrate by thermal processes such as conduction through solid joints in the building frame and by convection in the air filled cavities of hollow blocks, such as hollow bricks and cement blocks. The thermal performance and resistance of hollow blocks can depend on a number of factors, such as the number of cavities and the arrangement of the cavities in the hollow blocks, for example. Convection can allow for external heat to enter into the interior of the building because particles of fluid, such as air, located in the cavities can begin to move freely when heated, which can increase the kinetic energy of the fluid. As kinetic energy increases, the thermal resistance of the brick can decrease, thereby typically increasing the amount of heat entering into the interior of the building. Thus, temperature control inside the interior of the building can become harder to maintain, which can result in greater consumption of energy, such as to cool the building.

Current approaches to increase the thermal resistance of hollow blocks include changing the number of cavities or modifying the arrangement of cavities within the hollow block. Another approach is filling in the cavities of the hollow block with a material, such as rubber or polystyrene foam. However, these approaches typically only increase the thermal resistance of the hollow block by about 20% to about 30%. Further, the second approach of filling in the cavities with a material generally does not take into consideration the air within the cavity, since the air within the cavity is usually completely displaced by the filled in material. This can be detrimental because air typically has a lower conductivity value than rubber or polystyrene foam. For example, air has a conductivity value of about one-tenth that of rubber. This means air relatively has a greater thermal resistance R-value and, therefore, can act as a better insulator from external heat. Thus, it would be beneficial for the air to remain inside the cavities to provide for increased thermal resistance.

Therefore, it is desirable for a thermal control insert to increase the thermal resistance of a hollow block and reduce the heat transfer by natural convection inside the cavities of the hollow block and for a thermal resistant block to utilize the air located within its cavities.

Thus, a thermal control insert for hollow blocks and a thermal resistant hollow block addressing the aforementioned problems is desired.

SUMMARY OF THE INVENTION

A thermal control insert for a hollow block and a thermal resistant hollow block are provided. The thermal control insert is an elongate member adapted for positioning within a cavity of the hollow block. The elongate member includes a spiral shaped pathway that forms a closed pathway which receives a heated fluid when the elongate member is positioned within the cavity of the hollow block. The heated fluid is transferred by convection through the closed pathway towards a central open area of the elongate member located at an inner end of the closed pathway. As the heated fluid accumulates within the central open area, the heated fluid will lose kinetic energy and become stagnant to provide a relatively high thermal resistance to heat transfer. The thermal resistant block includes a hollow block having at least one cavity and at least one elongate member positioned within the cavity that has a spiral shaped pathway which forms a closed pathway to receive a heated fluid.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
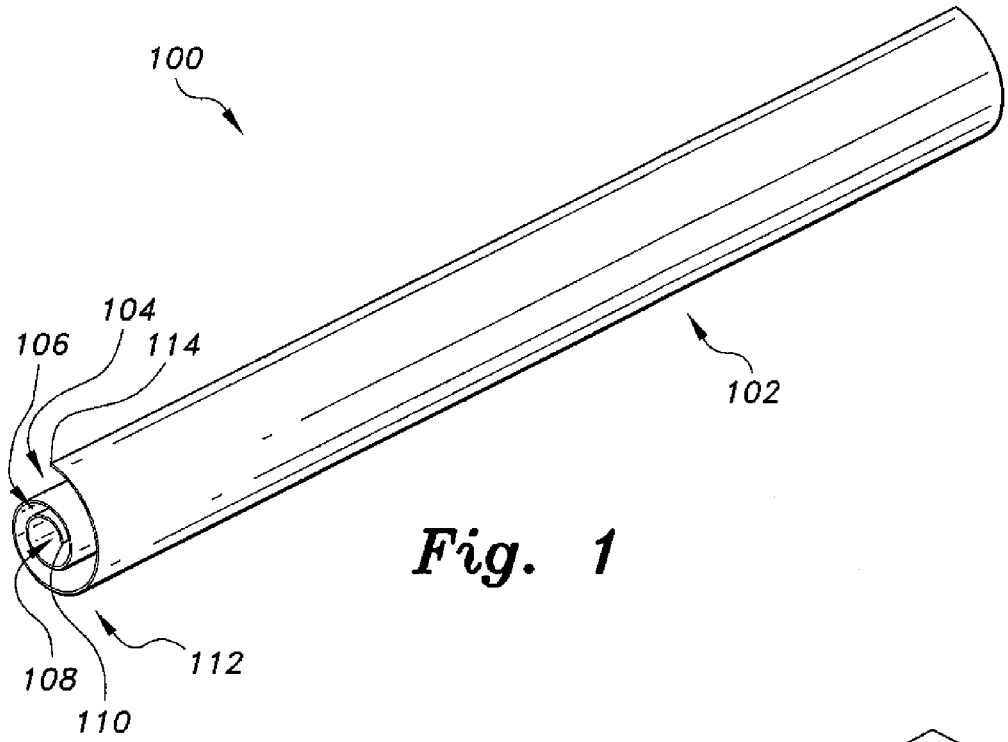
FIG. 1 is a perspective view of an embodiment of a thermal control insert for a hollow block according to the present invention.
Figure 2:
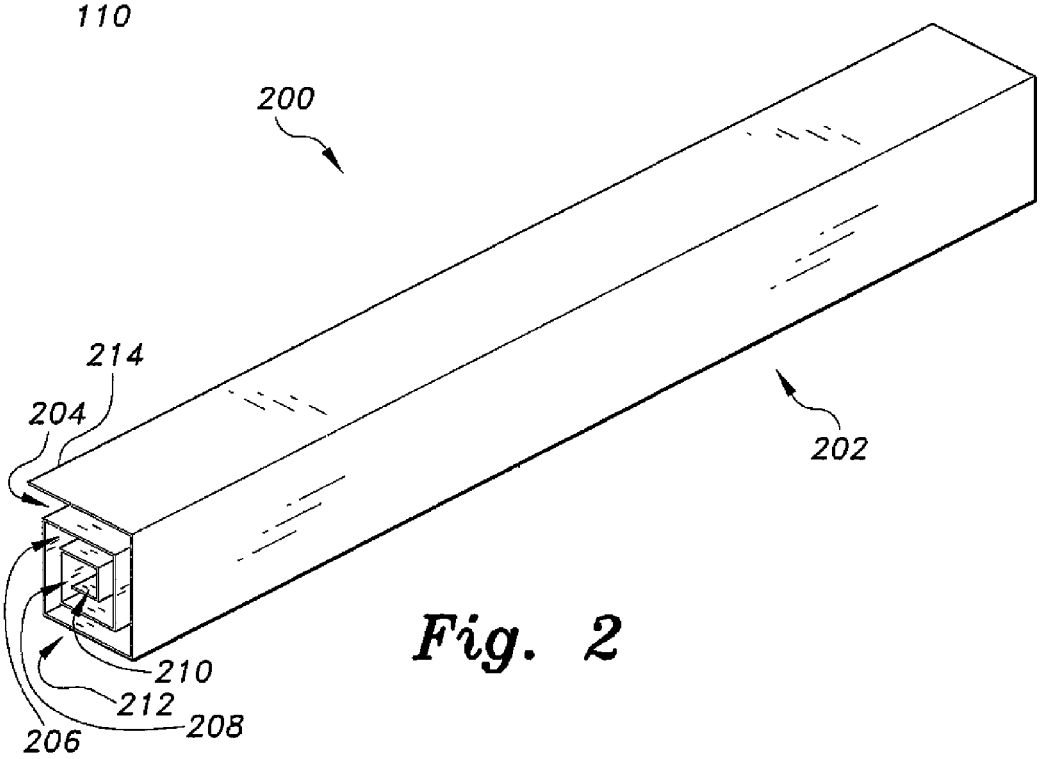
FIG. 2 is a perspective view of an embodiment of a thermal control insert for a hollow block according to the present invention.
Figure 3:
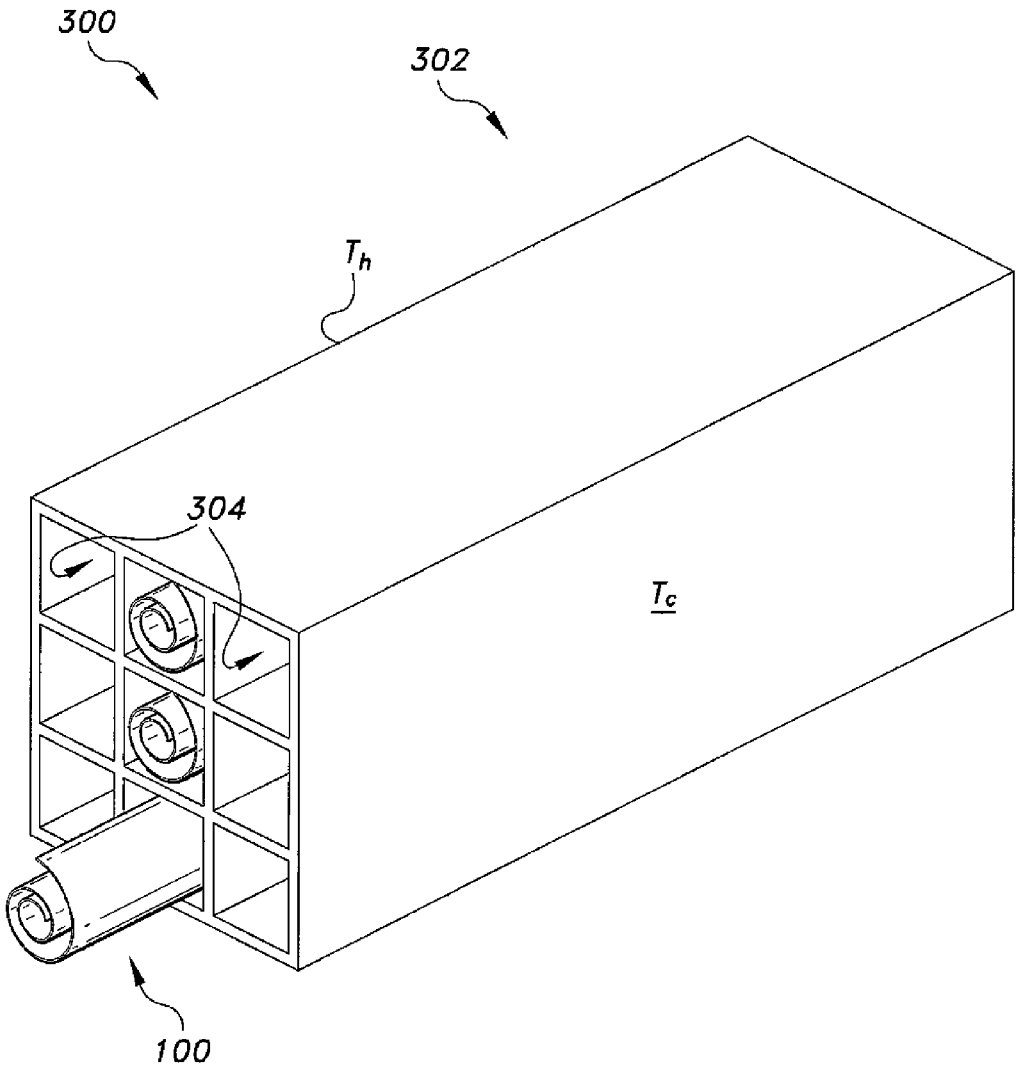
FIG. 3 is a perspective view of an embodiment of a thermal resistant hollow block according to the present invention.

Referring to FIGS. 1 and 3, an embodiment of a thermal control insert 100 and an embodiment of a thermal resistant hollow block 300 are shown. Also, referring to FIGS. 2 and 4, an embodiment of a thermal control insert 200 and an embodiment of a thermal resistant hollow block 400 are shown. Thermal control insert 100 has an elongate member 102 that is adapted for positioning within a cavity 304 of a hollow block 302 in forming the thermal resistant hollow block 300. Also, thermal control insert 200 has an elongate member 202 that is adapted for positioning within a cavity 404 of a hollow block 402 in forming the thermal resistant hollow block 400. Cavities 304 of FIGS. 3 and 404 of FIG. 4 include a void formed by the cavity and a fluid occupying the void, such as air, when a hollow block, such as the hollow blocks 302 and 402, is used in construction. The elongate members 102 and 202 can be adjusted to have dimensions to correspond to and fit within a cavity, such as cavities 304 and 404, of a hollow block, such as hollow blocks 302 and 402, to ensure a more secure fit within the cavity.

Figure 5:
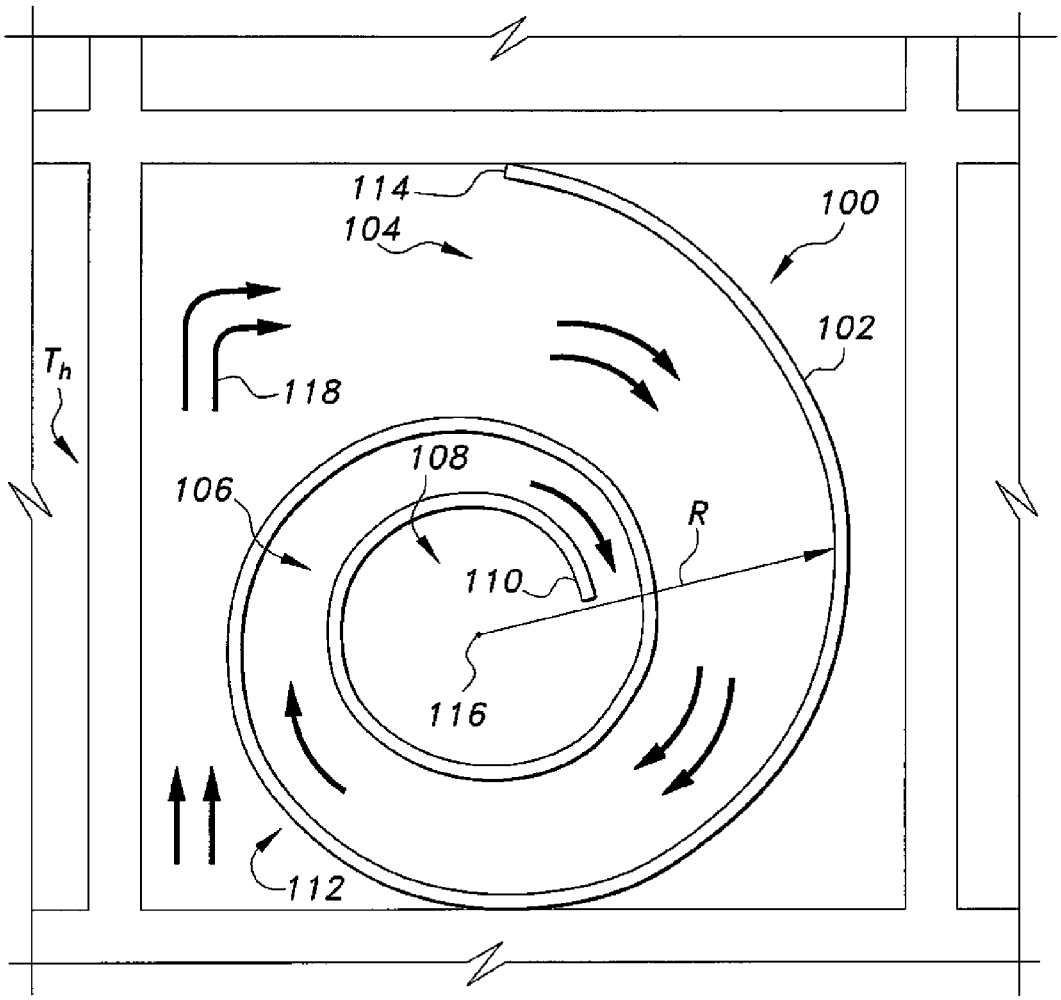
FIG. 5 is an end view of an embodiment of a thermal resistant hollow block according to the present invention.

Continuing with reference to FIGS. 1, 3 and 5, elongate member 102 can have a generally spiral shape and has a generally spiral shaped pathway 104. If elongate member 102 is positioned within a corresponding cavity, for example a corresponding cavity 304, the generally spiral shaped pathway 104 is adapted for an outer end 114 of the generally spiral shaped passageway 104 to be positioned in facing relation to a surface of the corresponding cavity that receives and transfers heat. For example, FIG. 3 shows a heated surface $T_h$ of hollow block 302 that receives heat from a heat source, such as heat from the sun. The cavities 304 of hollow block 302 that are not heated by the heated surface $T_h$ of hollow block 302 can have their surfaces heated by the thermal process of conduction, for example. Conduction is a form of heat transfer by means of molecular collisions within a material without the material moving as a whole. More simply, if an end of a material is at a higher temperature than another end of the material, energy will typically be transferred down the material towards a cooler end because the higher speed heated particles collide with the slower cooled particles, transferring energy and warming the cooler end, The heated surface $T_h$ can transfer heat to the cavities, such as the cavities 304, through conduction since they have cool surfaces $T_c$ relative to heated surfaces $T_h$ and, therefore, the individual cavities, such as the cavities 304, can have a heated surfaces $T_h$ and a relatively cooler cool surface $T_c$, as well.

By positioning the outer end 114 of the generally spiral shaped pathway 104 in facing relation to a heated surface $T_h$, the fluid located within the corresponding cavity, such as a corresponding cavity 304, alongside a thermal control insert 100 is warmed by heat from the heated surface $T_h$. As shown in FIG. 5, the heated fluid 118 will travel upward into the generally spiral shaped pathway 104 in conjunction with convection currents, as indicated by the arrows for heated fluid 118, and into and through the generally spiral shaped pathway 104. Convection is a thermal process where heat transfer by mass motion of a fluid occurs when the fluid is heated, causing the heated fluid to move away from the source of heat, carrying energy through convection currents associated with the heated fluid. The heated fluid 118 can include a number of various fluids, such as a gas, e.g., an inert gas, but is typically air.

The heated fluid 118 travels upward into the generally spiral shaped pathway 104 and follows along and through a generally closed pathway 106 in conjunction with the convection currents. The generally closed pathway 106 is formed by the generally spiral shaped pathway 104. The generally closed pathway 106 extends from the outer end 114 of the generally spiral shaped passageway 104 that forms an outer end of the generally closed pathway 106 and leads to a central open area 108 at an inner end 110 of the generally closed pathway 106. The heated fluid 118 moves along the generally closed pathway 106 in a forward direction towards the central open area 108 at the inner end 110 where the heated fluid 118 is eventually stopped.

As the heated fluid 118, such as air, accumulates inside the central open area 108, the heated fluid 118 will lose its kinetic energy and become stagnant. The stagnant fluid can then act as an insulator inside the central open area 108, since the fluid, such as air, typically has a lower conductivity value, thereby increasing the thermal resistance of the hollow block, such as the hollow block 302. By adding thermal control insert 100 to one or more cavities 304 of the hollow block 302, the hollow block 302 forms the thermal resistant block 300 with an increased thermal resistance to heat.

The generally spiral shaped pathway 104 of thermal control insert 100 has a generally circular spiral shaped pathway 112 as seen in FIG. 5. The generally circular spiral shaped pathway 112 has a radius of curvature R that extends outward from a central point 116 in the central open area 108. As illustrated in FIG. 5, the radius of curvature R increases in magnitude extending from the central point 116 in a direction from the inner end 110 to the outer end 114 in the generally circular spiral shaped pathway 112 formed by the elongate member 102.

Figure 4:
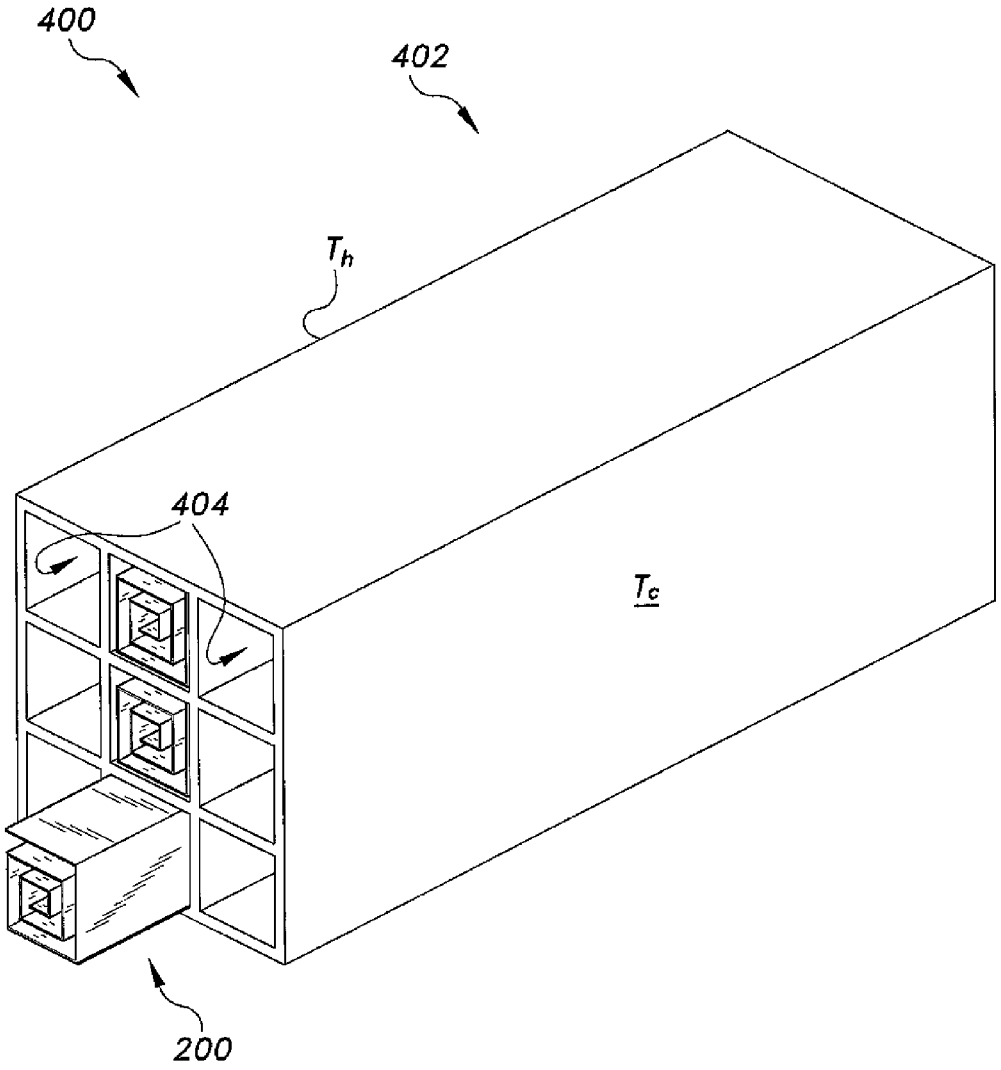
FIG. 4 is a perspective view of an embodiment of a thermal resistant hollow block according to the present invention.
Figure 6:
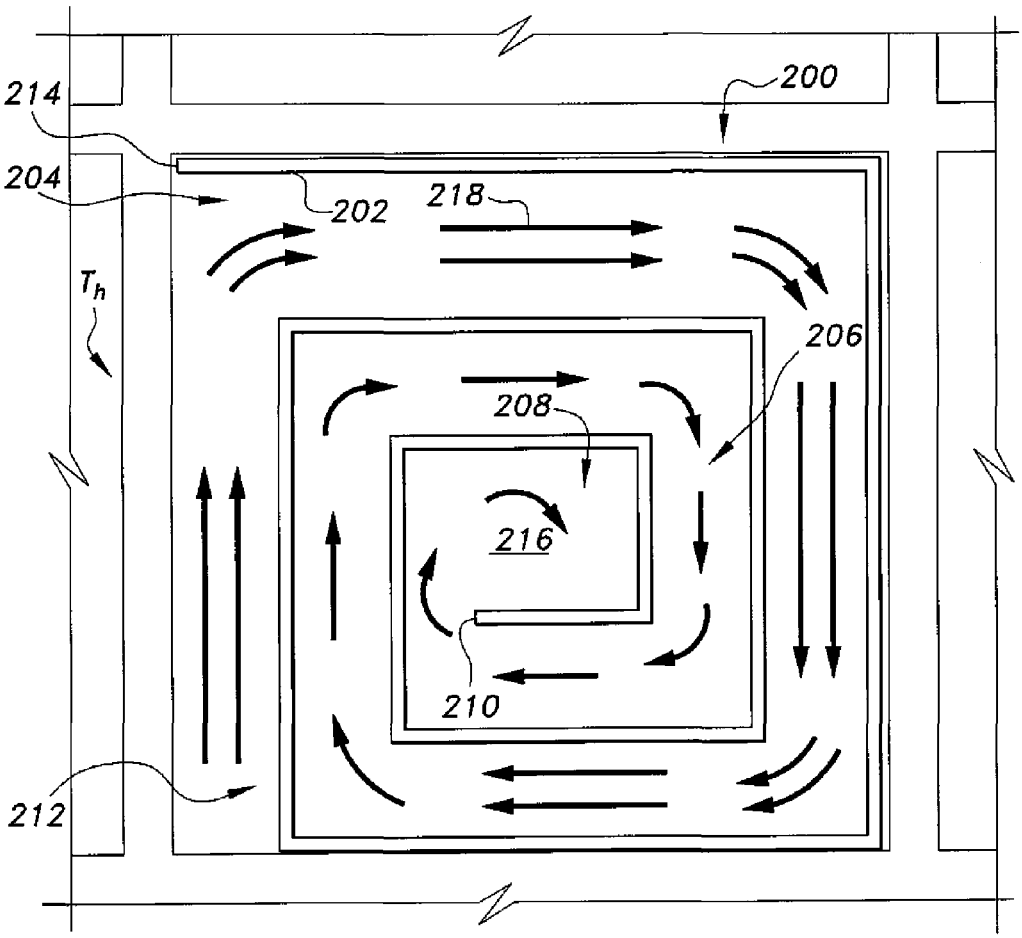
FIG. 6 is an end view of an embodiment of a thermal resistant hollow block according to the present invention.

Continuing with reference to FIGS. 2, 4 and 6, an embodiment of the thermal control insert 200 is illustrated having the elongate member 202 of a generally rectangular spiral shape that forms a generally spiral shaped pathway 204 having a generally rectangular spiral shaped pathway 212. If the elongate member 202 is positioned within a corresponding cavity, for example cavity 404, the generally spiral shaped pathway 204 forming the generally rectangular spiral shaped pathway 212 is adapted for an outer end 214 to be positioned in facing relation to a surface of the corresponding cavity that receives and transfers heat. For example, FIG. 4 shows a heated surface $T_h$ of the hollow block 402 that receives heat from a heat source, such as heat from the sun. The cavities 404 of hollow block 402 that are not heated by the heated surface $T_h$ of hollow block 402 can have their surfaces heated by the thermal process of conduction, for example. The heated surface $T_h$ can transfer heat to the cavities, such as the cavities 404, through conduction since they have cool surfaces $T_c$ relative to heated surfaces $T_h$ and, therefore, the individual cavities, such as the cavities 404, can have heated surfaces $T_h$ and a relatively cooler cool surface $T_c$, as well.

The generally spiral shaped pathway 204 has the outer end 214 that is positioned in facing relation to the heated surface $T_h$. The generally spiral shaped pathway 204 forms a closed pathway 206 for a heated fluid 218 to travel in a forward direction toward a central open area 208 at an inner end 210. Once at the central open area 208, the heated fluid 218 will become stagnant and lose its kinetic energy. Unlike the thermal control insert 100, the thermal control insert 200 does not have a radius of curvature extending from its central point 216 because of its generally rectangular spiral shaped pathway 212.

By positioning the outer end 214 of the generally spiral shaped pathway 204 in facing relation to a heated surface $T_h$, the fluid located within the corresponding cavity, such as a corresponding cavity 404, alongside a thermal control insert 200 is warmed by heat from the heated surface $T_h$. As shown in FIG. 6, the heated fluid 218 will travel upward into the generally spiral shaped pathway 204 forming the generally rectangular spiral shaped pathway 212, in conjunction with convection currents, as indicated by the arrows for heated fluid 218, and into and through the generally spiral shaped pathway 204. The heated fluid 218 can include a number of various fluids, such as a gas, e.g., an inert gas, but is typically air.

The heated fluid 218 travels upward into the generally spiral shaped pathway 204 and follows along and through the generally closed pathway 206. The generally closed pathway 206 is formed by the generally spiral shaped pathway 204. The generally closed pathway 206 extends from the outer end 214 of the generally spiral shaped passageway 204 that forms an outer end of the generally closed pathway 206 and leads to the central open area 208 at the inner end 210 of the generally closed pathway 206. The heated fluid 218 moves along the generally closed pathway 206 in a forward direction towards the central open area 208 at the inner end 210 where the heated fluid 218 is eventually stopped.

As the heated fluid 218, such as air, accumulates inside the central open area 208, the heated fluid 218 will lose its kinetic energy and become stagnant. The stagnant fluid can then act as an insulator inside the central open area 208, since the fluid, such as air, typically has a lower conductivity value, thereby increasing the thermal resistance of the hollow block, such as the hollow block 402. By adding thermal control insert 200 to one or more cavities 404 of the hollow block 402, the hollow block 402 forms the thermal resistant block 400 with an increased thermal resistance to heat.

The thermal control inserts 100 and 200 can be made from a number of different materials, such as paper, plastic, or metal, among others. Further, the thermal control inserts 100 and 200 can be made from a number of thermal insulating materials to provide further thermal insulation. Suitable thermal insulating materials include fiberglass or polyurethane, for example. Hollow blocks 302 and 402 of FIGS. 3 and 4 can be any of various common masonry blocks used in the construction industry. The hollow blocks 302 and 402 can be made from various suitable materials, including brick, stone, or concrete, among others. Also, the hollow blocks 302 and 402 can have any suitable number and arrangement of voids, including rows by columns, among others. Further, dimensions for the hollow blocks 302 and 402 can be any of various common dimensions, such as used in the construction industry in the building of walls, for example. For example, the hollow block 302 or the hollow block 402 can have typical construction industry common dimensions, such as 20 centimeters (cm)×20 cm×40 cm, with nine square voids in a 5 cm×5 cm rows and columns arrangement.

It is to be understood that the present invention is not limited to the embodiments described above, but encompasses any and all embodiments within the scope of the following claims.

I claim:

1. A thermal control insert for a hollow block, comprising:

an elongate member adapted to be positioned within a cavity formed in a hollow block, the elongate member having a generally spiral shaped pathway, the elongate member is comprised of an insulting material, the generally spiral shaped pathway forming:

i) an outer end to be positioned in a facing relation to a heated surface of the hollow block;

ii) a continuous pathway to an inner end to receive a fluid when positioned within the cavity of the hollow block, wherein the inner end is disposed away from the outer end and defines a central open area; and iii) at least six continuous changes of direction to define the spiral pathway whereby the fluid flows from the outer end towards the inner end, wherein the fluid moves along the generally spiral shaped pathway in a forward direction toward the central open area at the inner end of the generally closed pathway and the fluid accumulating in the central open area loses kinetic energy to provide a thermal resistance to heat transfer.

2. The thermal control insert for a hollow block according to claim 1, wherein the generally spiral shaped pathway of the elongate member is a generally circular spiral shaped pathway.

3. The thermal control insert for a hollow block according to claim 1, wherein the generally spiral shaped pathway of the elongate member is a generally rectangular spiral shaped pathway.

4. The thermal control insert for a hollow block according to claim 1, wherein the generally spiral shaped pathway allows for the fluid to be stacked in the central open area.

5. The thermal control insert for a hollow block according to claim 1, wherein the fluid comprises a gas.

6. The thermal control insert for a hollow block according to claim 1, wherein the fluid comprises air.

7. The thermal control insert for a hollow block according to claim 1, further comprising:

a plurality of said elongate members, each said elongate member adapted to be positioned within a cavity formed in a hollow block having a plurality of cavities, the plurality of elongate members each having said generally spiral shaped pathway, the generally spiral shaped pathway forming a generally closed pathway to receive a fluid when positioned within a corresponding said cavity of the plurality of cavities of the hollow block.

8. The thermal control insert for a hollow block according to claim 7, wherein said generally spiral shaped pathway of one or more of said plurality of elongate members is a generally circular spiral shaped pathway.

9. The thermal control insert for a hollow block according to claim 7, wherein said generally spiral shaped pathway of one or more of said plurality of elongate members is a generally rectangular spiral shaped pathway.

10. The thermal control insert for a hollow block according to claim 7, wherein a said generally spiral shaped pathway allows for the fluid to be stacked in the central open area at the inner end of a corresponding said generally closed pathway.

11. The thermal control insert for a hollow block according to claim 1, wherein said generally spiral shaped pathway of said elongate member comprises a walled structure forming the generally closed pathway having a radius of curvature measured from a central point in the central open area, the radius of curvature increasing in magnitude extending from the central point in the central open area in a direction from the inner end of the generally closed pathway to an outer end of the generally closed pathway formed by the elongate member.

12. A thermal resistant hollow block, comprising:

a hollow block having at least one cavity, wherein the block has a surface designated as a heated surface and an opposite surface designated as a cool surface; and at least one elongate member, each said elongate member positioned within a corresponding said cavity, said elongate member having a generally spiral shaped pathway, the generally spiral shaped pathway forming:

i) an outer end to be positioned in a facing relation to the heated surface of the hollow block;

ii) a continuous pathway to an inner end to receive a fluid when positioned within the cavity of the hollow block, wherein the inner end is disposed away from the outer end and defines a central open area; and iii) at least six continuous changes of direction to define the spiral pathway whereby the fluid flows from the outer end towards the inner end, wherein the fluid moves along the generally spiral shaped pathway in a forward direction toward the central open area at the inner end of the generally closed pathway of a corresponding said elongate member and the fluid accumulating in the central open area loses kinetic energy to provide a thermal resistance to heat transfer.

13. The thermal resistant hollow block according to claim 12, wherein the generally spiral shaped pathway of at least one said elongate member is a generally circular spiral shaped pathway.

14. The thermal resistant hollow block according to claim 12, wherein the generally spiral shaped pathway of at least one said elongate member is a generally rectangular spiral shaped pathway.

15. The thermal resistant hollow block according to claim 12, wherein the generally spiral shaped pathway allows for the fluid to be stacked in the central open area of a corresponding said elongate member.

16. The thermal resistant hollow block according to claim 12, wherein said hollow block is comprised of a clay material.

* * * * *